US008011028B2

(12) United States Patent
Grilliot et al.

(10) Patent No.: US 8,011,028 B2
(45) Date of Patent: Sep. 6, 2011

(54) FIREFIGHTER'S COAT WITH LINER IN TAIL POCKET

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 379 days.

(21) Appl. No.: 11/974,979

(22) Filed: Oct. 17, 2007

(65) Prior Publication Data

US 2009/0100567 A1 Apr. 23, 2009

(51) Int. Cl.

| | |
|---|---|
| ***A62B 17/00*** | (2006.01) |
| ***A62D 5/00*** | (2006.01) |
| ***A41D 3/02*** | (2006.01) |
| ***A41D 1/00*** | (2006.01) |

(52) U.S. Cl. ..... 2/458; 2/81; 2/85; 2/93

(58) Field of Classification Search ..... 2/455, 456, 2/458, 81, 85, 86, 93, 97; D2/828, 739
See application file for complete search history.

(56) References Cited

U.S. PATENT DOCUMENTS

| | | | | |
|---|---|---|---|---|
| D240,772 | S * | 8/1976 | Williams | D2/828 |
| 4,817,210 | A * | 4/1989 | Aldridge et al. | 2/81 |
| 5,189,737 | A * | 3/1993 | Ribicic | 2/81 |
| 5,542,124 | A | 8/1996 | Grilliot et al. | |
| 5,625,899 | A * | 5/1997 | Snedeker | 2/81 |
| 6,243,872 | B1 * | 6/2001 | Snedeker | 2/81 |
| 6,961,962 | B1 | 11/2005 | Lewis | |
| 2006/0277650 | A1 * | 12/2006 | Waters et al. | 2/81 |

* cited by examiner

*Primary Examiner* — Gary L Welch
*Assistant Examiner* — Amber R Anderson
(74) *Attorney, Agent, or Firm* — Wood, Phillips, Katz, Clark & Mortimer

(57) ABSTRACT

A firefighter's coat including an outer shell and a liner. The outer shell has an inner surface, an outer surface, a front opening with a closure, and a downwardly extending rear tail. The liner has an outer surface facing the inner surface of the shell providing a barrier against the environment. The liner outer surface has a bottom edge loose from the outer shell inner surface to facilitate air circulation for drying when the coat is not in use, and a pocket is defined along the bottom of the outer shell tail and adapted to receive the rear of the liner bottom edge when the coat is in use. A releasable fastener is adapted to releasably secure the liner in the pocket.

14 Claims, 2 Drawing Sheets

FIREFIGHTER'S COAT WITH LINER IN TAIL POCKET

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention pertains to a protective garment, and more particularly to a firefighter's coat having an outer shell with an inner liner incorporated therein.

BACKGROUND OF THE INVENTION AND TECHNICAL PROBLEMS POSED BY THE PRIOR ART

Commonly, a protective garment, such as a firefighter's coat, has an outer shell with an inner liner which may be secured to the outer shell by seams, snaps, hook and loop fasteners and the like on either side of the coat front opening and around the neck opening. In some coats, the connection also has extended around the bottom hem of the liner and shell as well, with connection along the hem being a seam or alternatively a detachable connection such as a tab of webbing with snaps or hook and loop fasteners such as in U.S. Pat. No. 5,542,124 (the disclosure of which is hereby fully incorporated by reference). In other coats, the liner and shell have not been connected along the web at all.

For example, U.S. Pat. No. 6,961,962 (the disclosure of which is hereby fully incorporated by reference) discloses a firefighter's coat in which two liner zippers are on each side of the closure zipper at the front of the outer shell. Such a structure enables the liner to be detached from the outer shell for cleaning and repair and/or replacement, as well as to facilitate drying if, for example, the coat became wet from use.

Of course, while removal of the liner may in some circumstances be desirable, it is also at times desirable to retain the liner in the outer shell between uses. This, of course, maintains the garment in a ready condition for use in the event of an emergency, and thereby allows the firefighter to respond to a call without delaying to find a liner and place it in the outer shell, and similarly ensures that a firefighter will be properly protected when he does respond quickly as is universally desirable (e.g., the firefighter need not choose between a quick response and properly protecting himself, nor need the risk inadvertently wearing an insufficiently protective coat).

In order to allow coats to properly dry after uses without requiring removal of the liner from the shell, the liners have in many instances hung loosely inside the torso portion of the shells with their bottom edges unconnected, whereby a gap will exist between the liner and shell. When hung to dry, the gap will facilitate air flow between the liner and shell and thereby also facilitate drying.

Unfortunately, allowing such space between the liner and shell to facilitate drying has also resulted in the liner being free so that it might unintentionally be misaligned inside the shell (e.g., when caught in some manner on the firefighter's pants or when the firefighter is putting on a self contained breathing apparatus prior to entering a fire), causing bunching and discomfort for the firefighter. Such undesirable bunching can also occur with the coats in which a tab of webbing is used at the hem.

The present invention is directed toward overcoming one or more of the problems set forth above.

SUMMARY OF THE INVENTION

In one aspect of the present invention, a firefighter's coat usable in extreme environments is provided, including an outer shell and a liner. The outer shell has an inner surface, an outer surface, a front opening with a closure, and a downwardly extending rear tail. The liner has an outer surface facing the inner surface of the shell providing a barrier against the environment, which liner outer surface has a bottom edge loose from the outer shell inner surface to facilitate air circulation for drying when the coat is not in use. A pocket is defined along the bottom of the outer shell tail and adapted to receive the rear of the liner bottom edge when the coat is in use.

In one form of this aspect of the invention, the pocket includes an inner layer secured along the bottom edge of the shell tail and overlapping the shell tail for a selected distance above the tail bottom edge, wherein the rear of the liner bottom edge is received between the shell and the inner layer when the coat is in use. In a further form, the inner layer includes an outer surface facing the outer shell inner surface, and a releasable fastener is adapted to releasably secure the liner to the inner layer outer surface. In a further form, the releasable fastener is a hook and loop fastener.

In another form of this aspect of the present invention, the liner is detachably securable to the shell front opening at both sides of the opening.

In another aspect of the present invention, a firefighter's coat usable in extreme environments is provided, including an outer shell and a liner. The outer shell has an inner surface, an outer surface, a front opening with a closure, and a downwardly extending rear tail. The liner has an outer surface facing the inner surface of the shell providing a barrier against the environment, with the liner outer surface having a bottom edge loose from the outer shell inner surface to facilitate air circulation for drying when the coat is not in use. An inner layer is secured along the bottom edge of the shell tail and overlaps the shell tail for a selected distance above the tail bottom edge to define a pocket therebetween, wherein the rear of the liner bottom edge is adapted to be received in the pocket between the shell and the inner layer when the coat is in use. A releasable fastener is adapted to releasably secure the liner to the inner layer outer surface.

In one form of this aspect of the invention, the inner layer includes an outer surface facing the outer shell inner surface, and the fastener releasably secures the liner to the inner layer outer surface. In a further form, the releasable fastener is a hook and loop fastener on the inner layer outer surface and on the liner inner surface adjacent the liner bottom edge.

In another form of this aspect of the invention, the liner is detachably securable to the shell front opening at both sides of the opening.

DETAILED DESCRIPTION OF THE INVENTION

Figure 1:
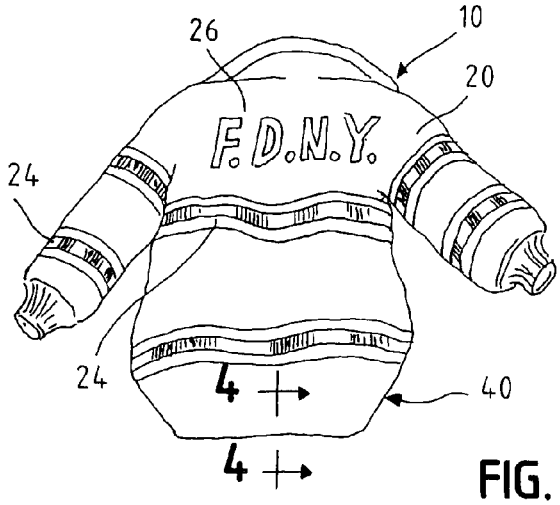
FIG. 1 is a view of the back of a fireman's coat in which the present invention is incorporated.

A firefighter's coat 10 exemplifying a protective garment provided by this invention is illustrated in the Figures. The coat 10 comprises an outer shell 20 with inner and outer surfaces and an inner liner 30 which may be suitably connected together, either detachably or permanently (e.g., by a closure zipper or a sewn seam). The outer shell 20 further has a bottom hem.

As is well known for firefighter's coats, the front of the coat 10 includes a closure opening which may include, for example, a suitable closure such as a zipper for opening and closing the outer shell 20. Further, the shell 20 may advantageously include reflective areas and strips 24 and identifying markings 26 on its outer surface to enhance the ability of others to see and identify the firefighter.

The liner 30 is suitably secured inside the outer shell 20, typically along each side of the outer shell closure opening (e.g., by two liner zippers on opposite sides of the closure zipper) as well as around the neck opening. It should be appreciated that the present invention may be advantageously used with virtually any attachments between the outer shell 20 and inner liner 30, whether permanent or detachable, with the limitations described below. The liner 30 has an outer surface facing the inner surface of the outer shell 20 and a bottom edge with a circumferential length extending around a wearer.

As best seen in FIG. 1, the coat 10 includes a downwardly extending tail 40 which extends downwardly in the back or rear of the coat 10 typically, though not necessarily, lower than the bottom hem of the sides and front of the coat 10.

An inner layer 50 is secured along the bottom edge of the shell tail 40 such as by stitching 54, with the layer 50 overlapping the shell tail 40 for a selected distance above the tail bottom edge/hem. The stitching 54 also extends up along the sides of the shell tail 40 so that an upwardly open pocket 60 is defined between the shell tail 40 and the inner layer 50. The stitching 54 secures the pocket 60 at all times, acting as a fastener at a bottom edge of the pocket 60 and at each side of the pocket 60, spaced from the stitching at the bottom edge of the pocket 60.

In accordance with the preferred form of the present invention, the liner 30 is not secured along its bottom edge to the outer shell 20. Further, the liner includes a downwardly extending rear tail 70 which extends lower than the sides of the liner 30. Alternatively, the liner 30 may have a relatively uniform height bottom hem, but with a suitable vertical cut 72 between the sides and the rear tail 70 allowing the rear tail 70 to extend into the pocket 60 as described herein.

Figure 4:
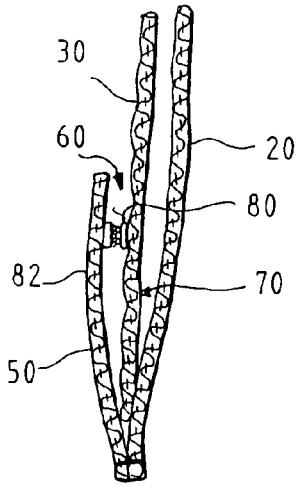
FIG. 4 is a cross-sectional view through the pocket in the tail of the fireman's coat taken along line 4-4 of FIG. 1.
Figure 2:
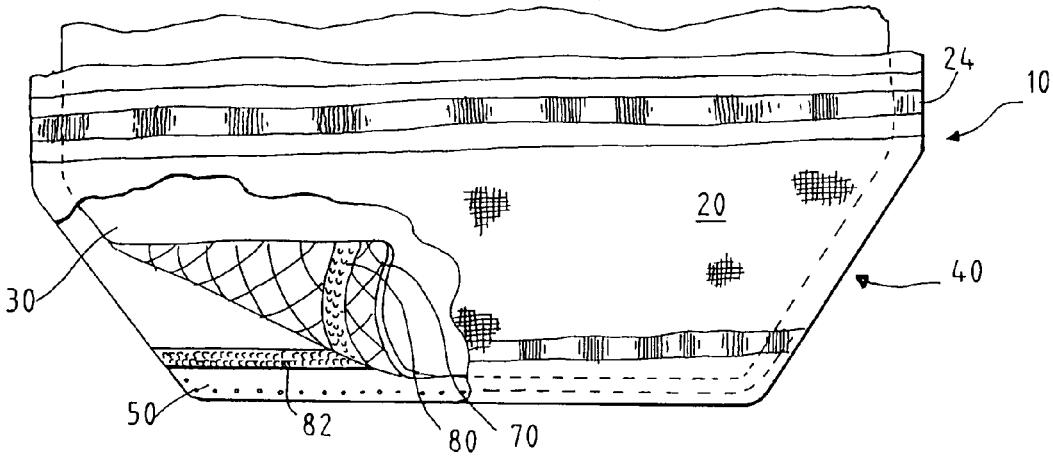
FIG. 2 is a partial back view of the fireman's coat of FIG. 1, showing the tail portion in which its layers are separated and peeled back along the bottom left corner.
Figure 3:
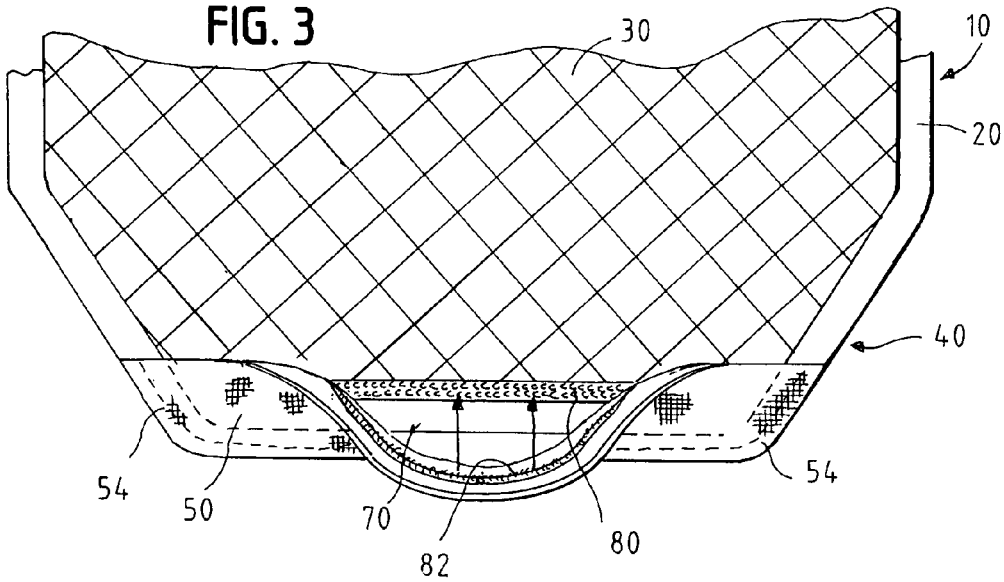
FIG. 3 is a view of the front, inner face of the back portion of the outer shell tail and liner tail of the fireman's coat with a portion of the pocket pulled away to show the connecting surfaces; ad
Figure 5:
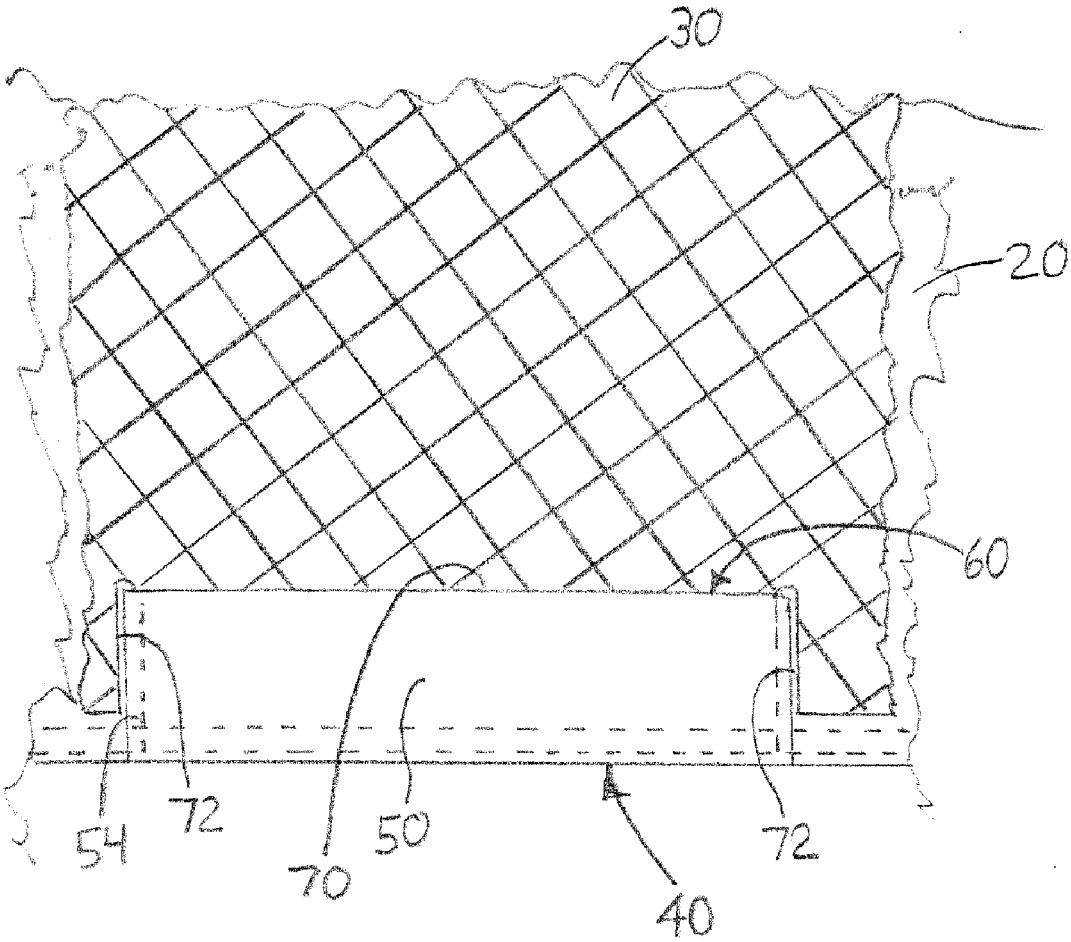
FIG. 5 is a partial view of the front, inner face of the back of the outer shell tail and liner tail of an alternate embodiment.

Specifically, as variously illustrated in FIGS. 2-4, the liner rear tail 70 advantageously extends down into the pocket 60 defined between the outer shell rear tail 40 and the inner layer 50. That is, only a discrete portion of the bottom edge of the inner liner 30, less than the full circumferential length of the bottom edge, is received in the pocket so that a space is defined along the bottom edge, spaced from the pocket, between the bottom hem of the outer shell and liner bottom edge through which air can flow vertically to and/or from between the outer shell and liner to facilitate drying of the coat. Suitable detaching fasteners may be provided to releasably retain the liner tail 70 in the pocket 60, such as aligned hook and loop fasteners 80, 82 secured across the inner surface of the liner 30 and the outer surface of the inner layer 50.

It should be appreciated that when the liner rear tail 70 is secured in the pocket 60 as described herein, the liner 30 will be secured so that its bottom will not bunching up and cause the lower portion of the coat 10 to fail to provide the full intended protection for the wearer (as well as to make the coat 10 uncomfortable for the wearer). That is, the bottom of the liner tail 70 is protected by the inner layer 50 so that relative movement upward inside the coat 10 of, for example, the firefighter's pants will not be able to catch on the bottom edge of the tail 70 and therefore will not pull the tail 70 upward with it.

Moreover, this securement is provided while still allowing the aforementioned space along the bottom edge between the outer shell 20 and the liner 30 (along the sides and front of the coat 10) to facilitate air flow and drying should moisture get inside the coat 10. Such drying is enhanced not only when hanging the coat 10 between uses but also while being worn by the firefighter.

Still further, it should be appreciated that between uses the fasteners 80, 82 may be detached and the liner tail 70 removed from the pocket 60 between uses. This enables drying of the coat 10 to be facilitated by providing the air flow providing bottom gap between the shell 20 and liner 30 around the entire bottom of the coat 10 without requiring that the liner 30 be removed. In this manner, the coat 10 may be ready for quick use the next time a need arises without causing any delay in responding to a fire from retrieving and securing a liner into the outer shell. The coat 10 will be ready for use by quickly and easily reinserting the liner tail 70 into the pocket 60. (Moreover, even if a firefighter should forget to insert the tail 70 into the pocket 60, or choose not to take the minimal time required to do so, that firefighter will still be wearing a coat 10 with the desired protective liner 30. Even in the worst case, such a firefighter's coat 10 would merely have a liner 30 which conceivably could bunch up, as already could occur with prior art coats in any event.)

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A firefighter's coat usable in extreme environments, comprising:

an outer shell having an inner surface, an outer surface, and a bottom hem with sides and a rear tail;

a liner having an outer surface facing the inner surface of the shell providing a barrier against the environment, said liner outer surface having a bottom edge, the liner bottom edge having a full circumferential length to extend around a wearer and a discrete portion extending along the liner bottom edge having a first length less than the full circumferential length at the rear tail of the outer shell; and a pocket defined along the bottom of the outer shell tail and having spaced sides, said pocket to receive only the first length of said liner bottom edge so that a space is defined, along the bottom edge spaced from the pocket, between the bottom hem of the outer shell and liner bottom edge through which air can flow vertically to and/or from between the outer shell and liner to facilitate drying of the coat, the pocket secured by a bottom fastener at a bottom edge of the pocket and at least one fastener on each of the spaced sides of the pocket spaced from the bottom fastener that remain fastened at all times.

2. The firefighter's coat of claim 1, wherein said bottom hem is substantially even.

3. The firefighter's coat of claim 2, further comprising slits on opposite sides of said rear of said liner bottom edge.

4. The firefighter's coat of claim 1, wherein said rear tail bottom hem extends lower than the bottom hem of the sides.

5. The firefighter's coat of claim 1, wherein said pocket comprises an inner layer secured along the bottom edge of the shell tail and overlapping the shell tail for a selected distance above the tail bottom edge, wherein said rear of said liner bottom edge is received between the shell and the inner layer.

6. The firefighter's coat of claim 5, wherein said inner layer includes an outer surface facing said outer shell inner surface, and further comprising a releasable fastener adapted to releasably secure said liner to said inner layer outer surface.

7. A firefighter's coat usable in extreme environments, comprising:

an outer shell having an inner surface, an outer surface, a front and rear, a front opening with a closure, and a downwardly extending rear tail;

a liner having a front and rear and an outer surface facing the inner surface of the shell providing a barrier against the environment, said liner having a bottom edge; and a pocket defined along the bottom of the outer shell tail and having spaced sides, said pocket adapted to receive the liner bottom edge at the rear of the outer shell and not at the front of the outer shell so that a space is defined along a portion of the bottom edge spaced from the pocket between the liner and the outer shell at the bottom edge through which air can flow vertically to and/or from between the outer shell and liner to facilitate drying of the coat, the pocket secured by a bottom fastener at a bottom edge of the pocket and at least one fastener on each of the spaced sides of the pocket spaced from the bottom fastener that remain fastened at all times.

8. The firefighter's coat of claim 7, wherein said pocket comprises an inner layer secured along the bottom edge of the shell tail and overlapping the shell tail for a selected distance above the tail bottom edge, wherein said rear of said liner bottom edge is received between the shell and the inner layer when said coat is in use.

9. The firefighter's coat of claim 8, wherein said inner layer includes an outer surface facing said outer shell inner surface, and further comprising a releasable fastener adapted to releasably secure said liner to said inner layer outer surface.

10. The firefighter's coat of claim 9, wherein said releasable fastener is a hook and loop fastener.

11. A firefighter's coat usable in extreme environments, comprising:

an outer shell having an inner surface, an outer surface, a front opening with a closure, and a bottom hem with a rear tail;

a liner having an outer surface facing the inner surface of the shell providing a barrier against the environment, said liner outer surface having a bottom edge with a front and rear;

an inner layer secured along a portion of the bottom edge of the shell tail and overlapping the shell tail for a selected distance above the tail bottom edge to define a pocket with spaced sides therebetween, wherein said rear of said liner bottom edge and not the front of the liner bottom edge is adapted to be received in said pocket between the shell and the inner layer so that a space is defined along the bottom edge spaced from the pocket between the bottom hem of the outer shell and liner bottom edge through which air can flow vertically to and/or from between the outer shell and liner to facilitate drying of the coat; and a releasable fastener adapted to releasably secure said liner to said inner layer, the pocket secured by a bottom fastener at a bottom edge of the pocket and at least one fastener on each of the spaced sides of the pocket spaced from the bottom fastener that remain fastened at all times.

12. The firefighter's coat of claim 11, wherein said shell rear tail hem extends downwardly lower than said hem at said sides.

13. The firefighter's coat of claim 11, wherein said inner layer includes an outer surface facing said outer shell inner surface, and said fastener releasably secures said liner to said inner layer outer surface.

14. The firefighter's coat of claim 13, wherein said releasable fastener is a hook and loop fastener on said inner layer outer surface and on the liner inner surface adjacent the liner bottom edge.

* * * * *